United States Patent [19]

McLees et al.

[11] Patent Number: 5,076,878

[45] Date of Patent: Dec. 31, 1991

[54] DEVICE FOR APPLYING ADHESIVE TO ELONGATE MEMBERS

[75] Inventors: Herbert A. McLees; Randall G. Koza, both of St. Paul, Minn.

[73] Assignee: Minnesota Mining and Manufacturing Company, St. Paul, Minn.

[21] Appl. No.: 488,606

[22] Filed: Mar. 2, 1990

[51] Int. Cl.[5] ..... B32B 31/00; B65H 26/00; B26D 5/00

[52] U.S. Cl. ..... 156/353; 156/361; 156/510; 156/521; 156/522

[58] Field of Search ..... 156/510, 516, 519, 521, 156/522, 540, 541, 542

[56] References Cited

U.S. PATENT DOCUMENTS

| | | | |
|---|---|---|---|
| 3,066,723 | 12/1962 | Remington et al. | 156/522 |
| 3,406,084 | 10/1968 | Varga | 156/522 |
| 3,765,992 | 10/1973 | Stageberg | 156/521 |
| 4,459,170 | 7/1984 | Kerwin | 156/542 |
| 4,636,276 | 1/1987 | Nozaka | 156/540 |
| 4,861,411 | 8/1989 | Tezuka | 156/510 |
| 4,980,011 | 12/1990 | Gruber et al. | 156/522 |

*Primary Examiner*—David A. Simmons
*Assistant Examiner*—Jeffrey G. Payne
*Attorney, Agent, or Firm*—Gary L. Griswold; Walter N. Kirn; William L. Huebsch

[57] ABSTRACT

A device adapted to apply a length of adhesive from a supply length of the adhesive releasably adhered to a liner along the length of an elongate member. A head carrying a plurality of pressure rollers is positioned in a contact position so that a first one of the pressure rollers presses the adhesive against the side surface of the elongate member at about a predetermined position adjacent the first end of the elongate member, and then the head is positioned in a pressure position so that upon further movement of the elongate member along the path all of the pressure rollers will cause the adhesive to be firmly pressed into engagement along the elongate member through the liner. The adhesive is cut adjacent a last pressure roller on the head after a length is applied, and the newly severed end of the adhesive is then moved from adjacent the last pressure roller to adjacent the first pressure roller in preparation for application of adhesive to the next elongate member.

6 Claims, 5 Drawing Sheets

DEVICE FOR APPLYING ADHESIVE TO ELONGATE MEMBERS

TECHNICAL FIELD

The present invention relates to devices for applying a strip of adhesive along the surface of a member as the member moves relative to the device.

BACKGROUND OF THE INVENTION

The art is replete with devices for applying a strip of adhesive along the surface of a member as the member moves along a path relative to the device. Such devices, however, have been found unsuitable for applying adhesive along the side of an elongate member of the type made of fibrous paper like material and used as a core for a roll of paper, primarily because of the somewhat irregular rough peripheral surface defined by fibrous material thin outer layers of which can easily delaminate from the core to form and even rougher and irregular outer surface of the elongate member, and the inability of the pressure rollers or shoes on known adhesive application devices to bring the adhesive into sufficiently intimate engagement with such a peripheral surface to reliably adhere the adhesive to it.

DISCLOSURE OF INVENTION

The present invention provides a device that can reliably and firmly apply adhesive along the surface of an elongate member moved relative to the device, including along an irregular and rough peripheral surface defined by fibrous material such as typifies the outer surface on a hollow cylindrical core of the type around which paper is wound, so that the adhesive can adhere an end of a length of paper to the core that can then be rotated to wind the paper around it.

According to the present invention there is provided a device adapted to apply a length of adhesive from a supply length of the adhesive releasably adhered to a liner along the length of an elongate member. The device comprises a frame and means for guiding lengthwise movement of the elongate member along an elongate member path relative to the frame in a first direction, with the first end of the elongate member leading, from an initial position with the first end of the elongate member adjacent an initial position on the frame to an outlet position with the second end of the elongate members adjacent an outlet position on the frame, which outlet position is spaced in the first direction from the inlet position.

The device includes a plurality of rollers comprising first and last rollers each mounted on the head for rotation about an axis, with the axes of the rollers being parallel and the rollers having generally aligned side surfaces adapted to press the adhesive against the side surface of the elongate member. Articulating and biasing means mount the head on the frame between the initial and outlet positions along the elongate member path for movement in a predetermined pattern with the side surfaces of the rollers adjacent the elongate member path, the first roller adjacent the inlet position, and the last roller adjacent the outlet position and include means for biasing the rollers to predetermined positions in the predetermined pattern. Supply support means is provided on the frame for supporting a supply length of the liner having the length of adhesive releasably adhered thereto; as are liner collecting means for collecting the liner after application of the length of adhesive and for applying a predetermined tension along the liner to move the liner into the liner collecting means. Means are provided for defining a liner path for the liner that sequentially includes (1) a supply path portion from the supply support means to the first roller adapted to guide the liner with the length of adhesive releasably adhered thereto to the first roller with the liner adjacent the side surface of the first roller, (2) the last roller, and (3) a liner take up portion from the last roller to the liner collecting means. The means for defining the supply path portion includes length changing means movable between a short position for defining a short supply path portion length and a long position for defining a long path portion length that is longer than the short supply path portion by a dimension about equal to the distance between the axes of the first and last rollers. Cutting means are also provided that include a cutting blade movable between a retracted position spaced from the liner path and the elongate member path and an engaged position with the blade at an engaged position intersecting the elongate member path and closely spaced from the liner path and on the side of the last roller opposite the first roller; together with brake means along the supply path portion between the length changing means and the supply support means adapted for movement between a release position affording movement of the liner having the length of adhesive releasably adhered thereto along the liner path, and an engaged position for stopping movement of the liner having the adhesive releasably adhered thereto along the liner path. The articulating and biasing means afford movement of the head between (1) a contact position with only the first roller positioned to bias the liner having the length of adhesive releasably adhered thereto into engagement with the elongate member adjacent the inlet position, and (2) a pressure position with both the first and last rollers positioned to bias the liner having the length of adhesive releasably adhered thereto into engagement with the elongate member along the elongate member path; and the device further includes control means, operated by movement the elongate member along the elongate member path with the first end of the elongate member leading, with the length changing means initially in the first position to define the long path portion length, and with the leading end of the length of adhesive initially adjacent the first roller, for (1) operating the articulating and biasing means to position the head in the contact position to press the liner and thereby the adhesive adjacent the end of the adhesive against the side surface of the elongate member adjacent the first end of the elongate member, and then position the head in the pressure position so that further movement of the elongate member along the elongate member path and tension in the liner caused by the liner collecting means will cause the adhesive and the liner to move with the elongate member and the adhesive to be firmly pressed into engagement along the length of the side surface of the elongate member through the liner as the elongate member with the adhesive adhered thereto moves past the head; (2) allow tension in the liner during movement of the elongate member along the head to move the length changing means from the long position to the short position; (3) move the brake means to the engaged position while sequentially moving the cutting means from the retracted position to the engaged position to sever adhesive extending between the last roller and the elongate member as the second end of the elongate member moves past the last roller, and moving the length changing means from the short position to the long position to pull the liner along the head from the last roller toward the first roller to move the newly severed end of the adhesive from adjacent the last roller to adjacent the first roller.

Such a device, because of the initial tacking of the adhesive that can be applied by a single roller and the repeated pressure applications that can be applied by the plurality of rollers, can press the adhesive into the intimate engagement with the elongate member as is needed to adhere the adhesive to cores of the type described above.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
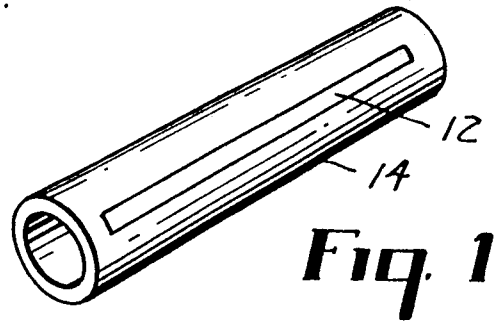
FIG. 1 is a perspective view of an elongate member or core having a length of pressure sensitive adhesive adhered to it as by a device according to the present invention.
Figure 4:
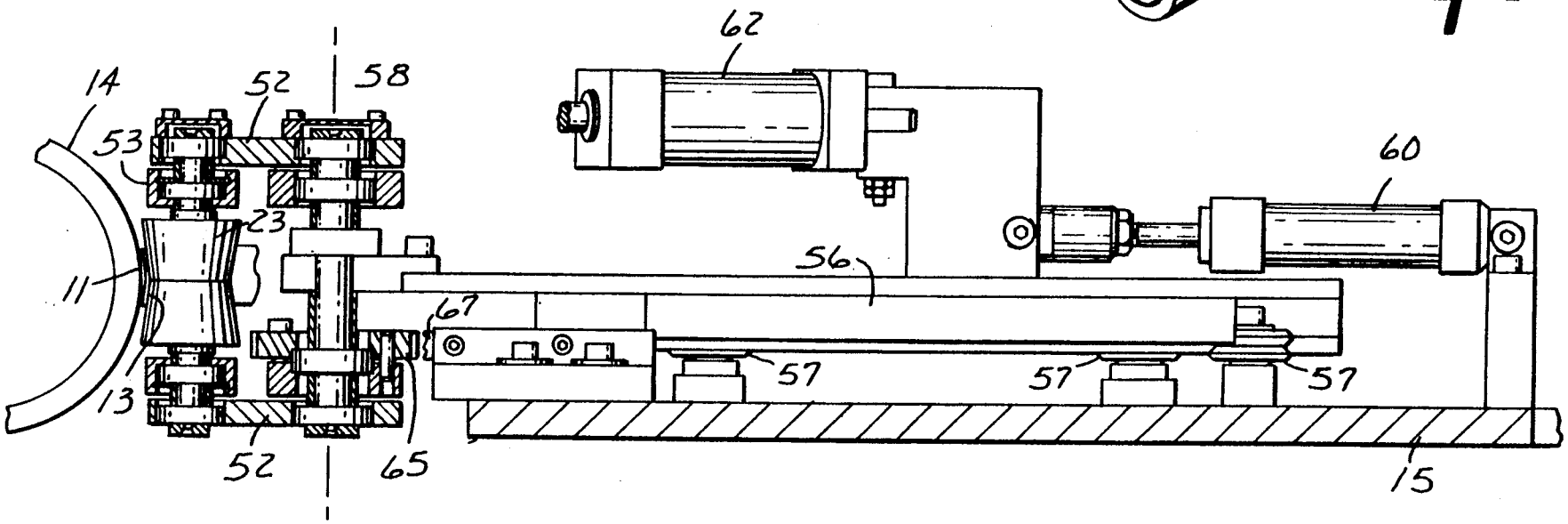
FIG. 4 is a sectional view taken approximately along line 4—4 of FIG. 2.

Referring now to the drawing, there is shown a device according to the present invention generally designated by the reference numeral 10, which device 10 is adapted to apply a length 12 of adhesive from a supply length 11 of the adhesive releasably adhered to a liner 13 along the length of an elongate member 14 having first and second ends (see FIG. 1 for an illustration of such a hollow cylindrical elongate member or core 14 on which paper can be wound to which core 14 the length 12 of adhesive has been adhered).

Generally the device 10 comprises a frame 15 and means in the form of elongate guide bars 16 for guiding lengthwise movement of the elongate member 14 along a elongate member path relative to the frame 15 in a first direction with the first end of the elongate member 14 leading from an initial position (FIG. 2) with the first end of the elongate member adjacent an initial position 17 on the frame 15 to an outlet position (FIG. 6) with the second end of the elongate member 14 adjacent an outlet position 18 on the frame 15, which outlet position 18 is spaced in the first direction from the inlet position 17. Included in the device 10 is a head 20, and a plurality of pressure rollers comprising a first pressure roller 21, a second pressure roller 22, a third pressure roller 23 and a last pressure roller 24; which pressure rollers 21, 22, 23, and 24 are each mounted on the head 20 for rotation about an axis. The axes of the pressure rollers 21, 22, 23, and 24 are parallel and the pressure rollers 21, 22, 23, and 24 have generally aligned side surfaces adapted to press the length of adhesive 11 against the side surface of the elongate member 14., Articulating and biasing means later to be explained mount the head 20 on the frame 15 between the initial and outlet positions 17 and 18 along the elongate member path for movement in a predetermined pattern with the side surfaces of the pressure rollers 21, 22, 23 and 24 adjacent the elongate member path, the first pressure roller 21 adjacent the inlet position 17, and the last pressure roller 24 adjacent the outlet position 18 and are adapted for biasing the pressure rollers 21, 22, 23, and 24 to predetermined positions in the predetermined pattern. Supply support means are provided in the form of a hub 26 rotatably mounted about a shaft 27 fixed on the frame 15, which hub 26 is adapted to receive a core 28 around which the liner 13 having the length 11 of adhesive releasably adhered thereto is helically wound. A friction plate 29 is fixed against rotation on the shaft 27, and is biased by a spring 30 against the hub 26 to apply a slight resistive force in the liner 13 to restrict unwinding of the helically wound liner 13 and length 11 of adhesive. Liner collecting means are provided for collecting the liner 13 after application of the length 12 of adhesive and for applying a predetermined tension along the liner 13 to move the liner 13 into the liner collecting means. The liner collecting means are in the form of a hub 32 rotatably mounted about a shaft 31, which shaft 31 is rotatably mounted on the frame 15. The hub 32 is adapted to receive a core **32*a* to which the end of the liner 13 is attached. A gear head motor assembly 33 is in driving engagement with the shaft 31 through a belt 34 and pulleys 35 and 36, and the shaft 31 is in torque limited driving engagement with the hub 32 through a friction plate 37 fixed against rotation on the shaft 31 that is biased by a spring 38 against the side surface of the hub 32 to apply a predetermined tension in the liner 13 that tends to wind the liner 13 onto the core 32. The device 10 also includes means defining a liner path for the liner 13 sequentially including a supply path portion from the hub 26 of the supply support means to the first pressure roller 21 adapted to guide the liner 13 with the length of adhesive 11 releasably adhered thereto to the first pressure roller 21 with the liner 13 (rather than the adhesive 11) adjacent the side surface of the first pressure roller 21, the last pressure roller 24, and a liner take up portion from the last pressure roller 24 to the hub 32 of the liner collecting means defined by a liner guide roller 41 rotatably mounted on the frame 15. The means for defining the supply path portion includes length changing means 39 movable between a short position (FIGS. 5 and 6) for defining a short supply path portion length, and a long position (FIGS. 2 and 3) for defining a long supply path portion length that is longer than the short supply path portion by a dimension about equal to the distance between the axes of the first and last pressure rollers 21 and 24. Cutting means are provided that include a cutting blade 40 movable between a retracted position (FIGS. 3 and 5) spaced from the liner path and the elongate member path and an engaged position (FIG. 6) with the blade 40 at an engaged position intersecting the elongate member path and closely spaced from the liner path and on the side of the last pressure roller 24 opposite the first pressure roller 21. Also, brake means 42 are provided along the supply path portion between the length changing means 39 and the supply support means adapted for movement between a release position affording movement of the liner 13 having the length 11 of adhesive releasably adhered thereto along the supply path portion, and an engaged position for stopping movement of the liner 13 having the length 11 of adhesive releasably adhered thereto along the supply path portion. The articulating and biasing means afford movement of the head 20 between (1) a contact position (FIG. 3) with only the first pressure roller 21 positioned to bias the liner 13 having the length 11 of adhesive releasably adhered thereto into engagement with the elongate member 14 adjacent the initial position 17, and (2) a pressure position (FIG. 5) with both the first and last pressure rollers 21 and 24 positioned to bias the liner 13 having the length of adhesive 11 releasably adhered thereto into engagement with the elongate member 14 along the elongate member path. The device 10 further includes control means (not shown) operated by movement the elongate member 14 along the elongate member path with the first end of the elongate member 14 leading, with the length changing means 39 initially in the first position to define the extended path portion length, and with the leading end of the length 11 of adhesive initially adjacent the first pressure roller 21, for (1) operating the articulating and biasing means to position the head 20 in the contact position to press the liner 13 and thereby the length 11 of adhesive adjacent the end of the adhesive against the side surface of the elongate member 14 adjacent the first end of the elongate member 14, and then position the head 20 in the pressure position so that further movement of the elongate member 14 along the elongate member path and tension in the liner 13 caused by the liner collecting means will cause the length 11 of adhesive 11 and the liner 13 to move with the elongate member 14 and the adhesive 11 to be firmly pressed into engagement along the length of the side surface of the elongate member 14 through the liner 13 as the elongate member 14 with the adhesive 11 adhered thereto moves past the head 20; (2) allowing tension in the liner 13 during movement of the elongate member 14 along the head 20 to move the length changing means 39 from the short position to the long position; (3) moving the brake means 42 to the engaged position while sequentially moving the blade 40 of the cutting means from the retracted position to the engaged position to sever adhesive 11 extending between the last pressure roller 24 and the elongate member 14 as the second end of the elongate member 14 moves past the last pressure roller 24, and moving the length changing means 39 from the short position to the long position to pull the liner 13 along the head 20 from the last pressure roller 24 toward the first pressure roller 21 to move the newly severed end of the adhesive 11 from adjacent the last pressure roller 24 to adjacent the first pressure roller 21**.

The supply path portion defining the liner path for the liner 13 from the hub 26 of the supply support means to the first pressure roller 21 is provided by a first guide roller 44 rotatably mounted on the frame 15 that is contacted by side of the liner 13 opposite the supply length 11 of adhesive, a tension applying guide roller 45 having a knurled cylindrical surface of a polymeric material not easily adhered to by the adhesive (e.g., "Delrin") around which the supply length 11 of adhesive extends and which is rotatably mounted on the frame 15 with an adjustable friction assembly between the guide roller 45 and the frame 15 so that a predetermined tension will be applied to the liner 13 after it is pulled around the guide roller 45, a movable guide roller 46 rotatably mounted on one end of an arm 47 pivotably mounted on the frame 15 for pivotable motion about an axis 48 spaced from the movable guide roller 46, and a forth guide roller 49 rotatably mounted on the frame 15 and also having a knurled cylindrical surface of a polymeric material not easily adhered to by the adhesive around which the supply length 11 of adhesive along the liner 13 extends. The tension applying guide roller 45, movable guide roller 46 and fourth guide roller 49 are included in the length changing means 39. The movable guide roller 46 is movable between a first position generally between the spaced fixed location liner guide rollers 45 and 49 which defines the short position (FIGS. 5 and 6) for defining a short supply path portion length, and a second position spaced at greater distance from the spaced fixed location liner guide rollers 45 and 49 than when the movable guide roller 46 is in the first position that defines the long position (FIGS. 2 and 3) for defining a long supply path portion. Actuating means in the form of an air cylinder 50 connected between a projecting portion of the arm 47 and the frame 15 is adapted for moving the movable guide roller 46 to the second position and affords (by being deactivated) movement of the movable guide roller 46 to the first position. The liner 13 and supply length 11 of adhesive extend around the side of the spaced fixed location liner guide rollers 45 and 49 opposite the movable guide roller 46 with a portion of the liner 13 between the spaced fixed location liner guide rollers 45 and 49 extending around the side of the movable guide roller 46 opposite the spaced fixed location liner guide rollers 45 and 49.

The brake means 42 is provided an end portion 51 on a plunger in an air cylinder 55 that can be activated to press the end portion 51 against the side surface of the tension applying guide roller 45 to stop movement of the liner 13 and length 11 of adhesive and stop rotation of the tension applying guide roller 45, or can be activated to retract the end portion 51 from the side surface of the tension plying guide roller 45 to afford movement of the liner 13 and the length 11 of adhesive along the liner path and afford rotation of the tension applying guide roller 45.

The head 20 comprises a major support portion 52 with the first and third pressure rollers 21 and 23 being rotatably mounted on the major support portion 52, and the head 20 also comprises minor support portions 53 with the second and last pressure rollers 22 and 24 being rotatably mounted on the minor support portions 53. The minor support portions 53 are mounted on the major support portion 52 for movement between projecting positions with the second and last pressure rollers 22 and 24 moved slightly out of alignment with the first and third pressure rollers 22 and 24 on the side of the head 20 adjacent the elongate member path, and an aligned position in alignment with the first and third pressure rollers 21 and 23, and biasing means in the form of springs 54 between the major and minor support portions 52 and 53 for biasing the second and last pressure rollers 22 and 24 toward the projecting positions so that when the pressure rollers 21, 22, 23 and 24 are biased into engagement with the side surface of the elongate member through the major support portion 52, movement of the minor support portions 53 will afford full engagement of all of the pressure rollers 21, 22, 23, and 24 with the side surface despite some irregularities along the side surface. The pressure rollers 21, 22, 23, and 24 all have axially central portions with generally the same diametrical dimensions and increase in diameter in both directions from the central portions so that the peripheries of the pressure rollers 21, 22, 23, and 24 generally conform to the side surface of the cylindrical elongate member 14.

The articulating and biasing means that mount the head 20 on the frame 15 between the initial and outlet positions along the elongate member path for movement in a predetermined pattern with the side surfaces of the pressure rollers 21, 22, 23, and 24 adjacent the elongate member path, the first pressure roller 21 adjacent the initial position 17, and the last pressure roller adjacent the outlet position 18 and that are adapted for biasing the pressure rollers 21, 22, 23, and 24 to predetermined positions in the predetermined pattern comprises (1) a slide 56 mounted by support rollers 57 on the frame 15 for movement in a first direction oriented at about a right angle with respect to the elongate member path between a pressure position and a retracted position at which retracted position the slide 56 is spaced further from the elongate member path than in the pressure position; (2) means mounting the head 20 on the slide 56 for pivotal movement around a pivot axis 58, the pivot axis 58 being parallel to the axes of the pressure rollers 21, 22, 23, and 24, being located about equidistant to the axes of the first and last pressure rollers 21 and 24, and being spaced from the sides of the pressure rollers 21, 22, 23, and 24 opposite the elongate member path, the head 20 being pivotable about the pivot axis between a first position with the first pressure roller 21 closer to the elongate member path than the last pressure roller 24, and a second position at which a line through the axes of the first and last pressure rollers 21 and 24 is about parallel with the elongate member path; (3) slide actuating means in the form of a double acting air cylinder 60 connected between the frame 15 and the slide 56 for alternatively biasing the slide 56 toward the pressure position or moving the slide 56 to the retracted position; and (4) head 20 pivoting means in the form of a double acting air cylinder 62 connected between the head 20 and the slide 56 that can be activated to pivot the head 20 to the first position and can be deactivated to afford pivoting of the head 20 to the second position. Activation of the air cylinder 60 to bias the slide 56 toward the pressure position and activation of the air cylinder 62 to pivot the head 20 to the first position causes movement of the head 20 to the contact position with only the first pressure roller 21 positioned to bias the liner 13 having the length 11 of adhesive releasably adhered thereto into firm high pressure engagement with the elongate member 14 adjacent the initial position 17, and activation of the air cylinder 60 to bias the slide 56 toward the pressure position and deactivation and venting of the air cylinder 62 to afford pivoting of the head 20 to the second position afford movement of the head 20 to the pressure position with both the first and last pressure rollers 21 and 24 positioned to bias the liner 13 having the length 11 of adhesive releasably adhered thereto into engagement with the elongate member 14 along the elongate member path.

Figure 3:
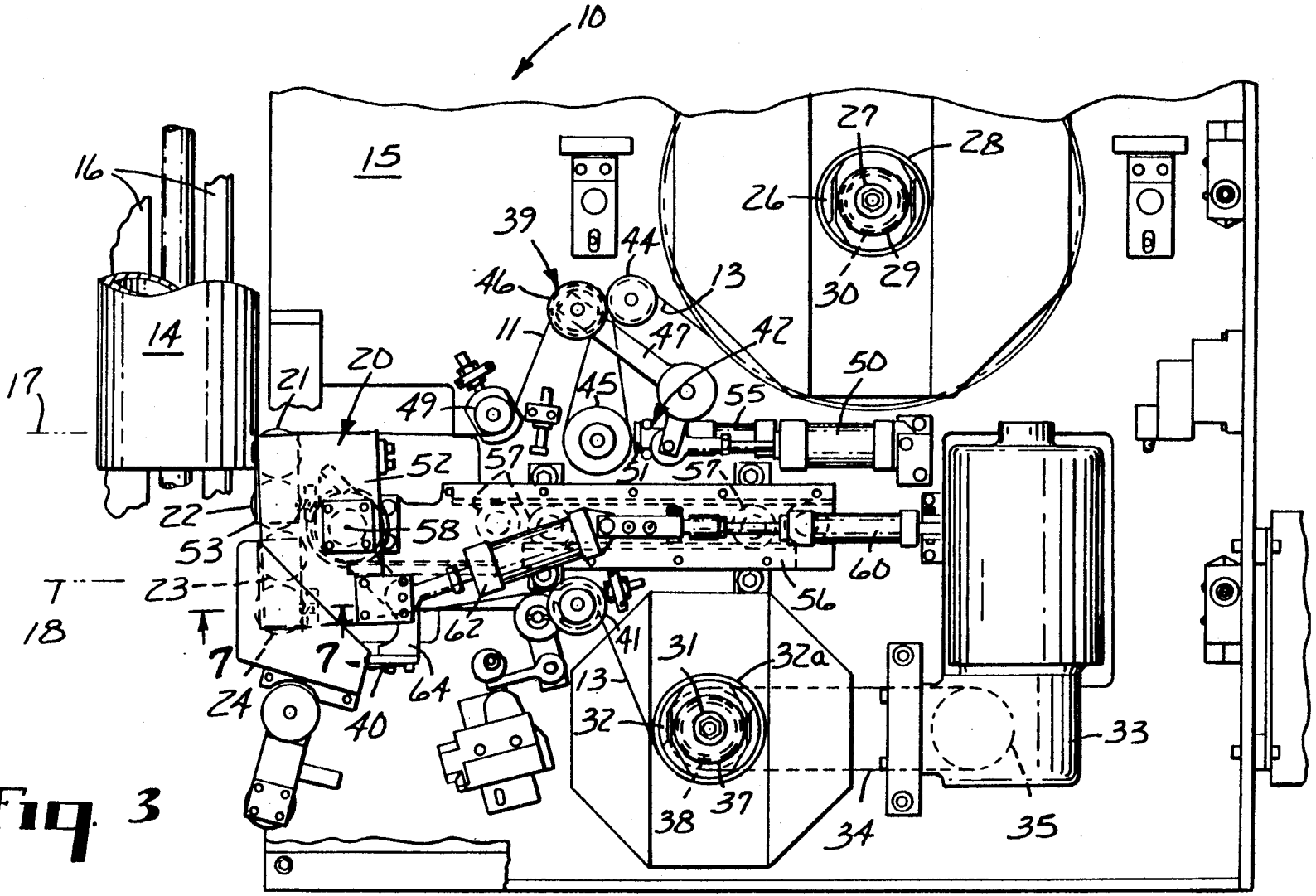
Figure 7:
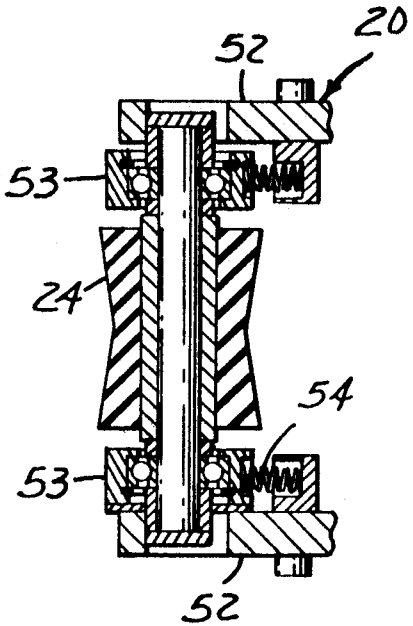
FIG. 7 is an enlarged sectional view taken approximately along line 7—7 of FIG. 3.
Figure 5:
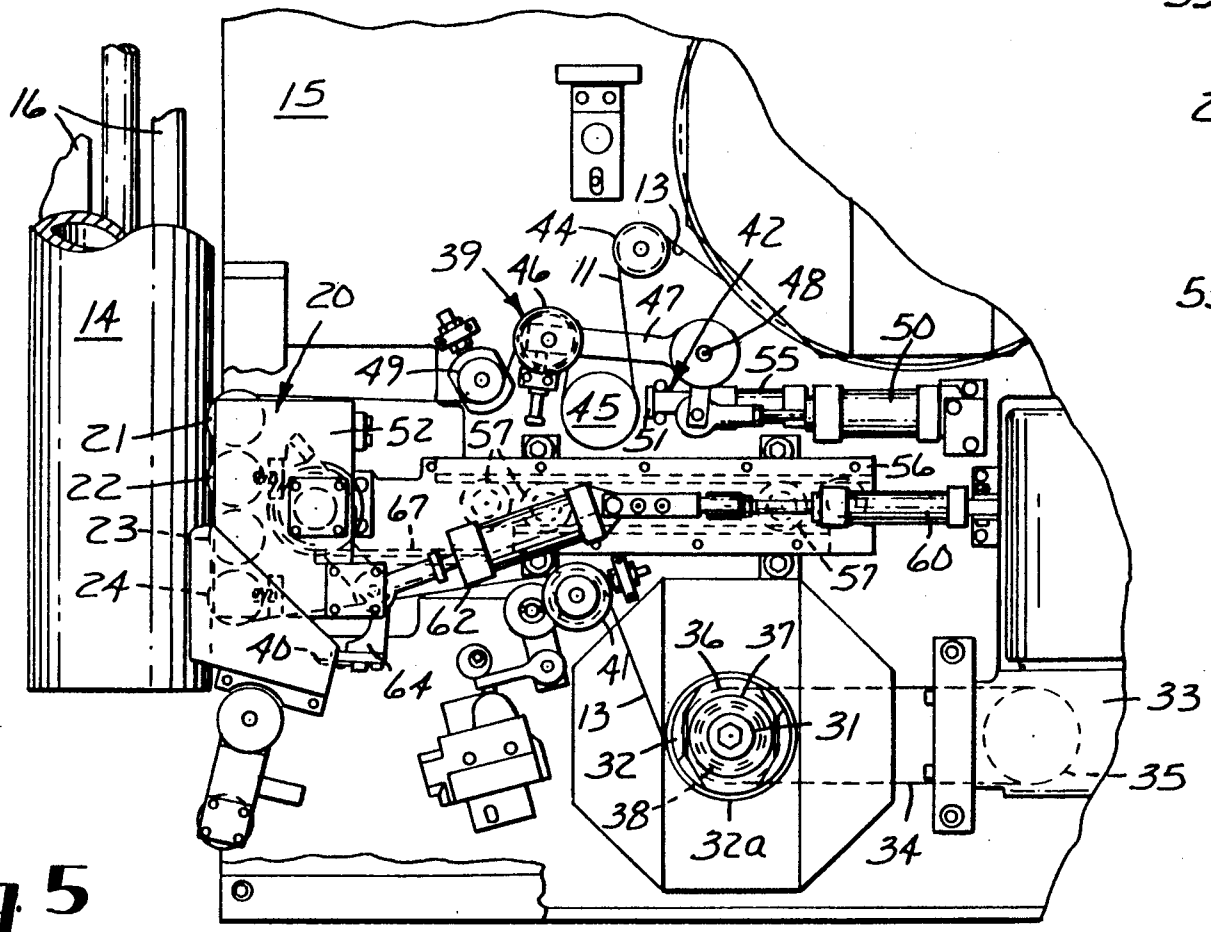
FIGS. 5 and 6 are enlarged fragmentary top plan views of the device according to the present invention illustrated in FIGS. 2 and 3 that further sequentially illustrate positions of portions of the device during application by the device of pressure sensitive adhesive along the length of an elongate member.

The head 20 is also pivotable about the pivot axis 58 to a third position in addition to the first and second positions, at which third position the last pressure roller 24 is closer to the elongate member path than the first pressure roller 21, and activation of the air cylinder 60 to move the slide 56 to the retracted position and activation of the air cylinder 62 to pivot the head 20 to the third position causes positioning of only the last pressure roller 24 in a position to bias the liner 13 having the length 11 of adhesive releasably adhered thereto into engagement with the elongate member 14 along the elongate member path adjacent the outlet position 18 while moving the first pressure roller 21 to a position spaced from the elongate member path. The cutting means includes a blade support member 64 supporting the cutting blade 40 and mounted on the slide 56 for pivotal movement about the pivot axis 58 for the head 20 to afford movement of the cutting blade 40 between the retracted and engaged positions, a gear 65 fixed to the blade support member 64 co axially with the pivot axis 58 for the head 20, and a rack 67 having teeth in engagement with the teeth on the gear 65 and fixed to the frame 15 at a right angle to the elongate member path on the side of the gear 65 adjacent the last pressure roller 24 so that movement of the slide 56 to the retracted position will cause movement of the cutting blade 40 to the engaged position with the cutting blade 40 intersecting the elongate member path and closely spaced from the liner path and on the side of the last pressure roller 24 opposite the first pressure roller 21 (FIG. 6), and movement of the slide 56 to the pressure position will move the cutting blade 40 to the retracted position spaced from the liner path and the elongate member path (FIGS. 3 and 5).

OPERATION

Figure 2:
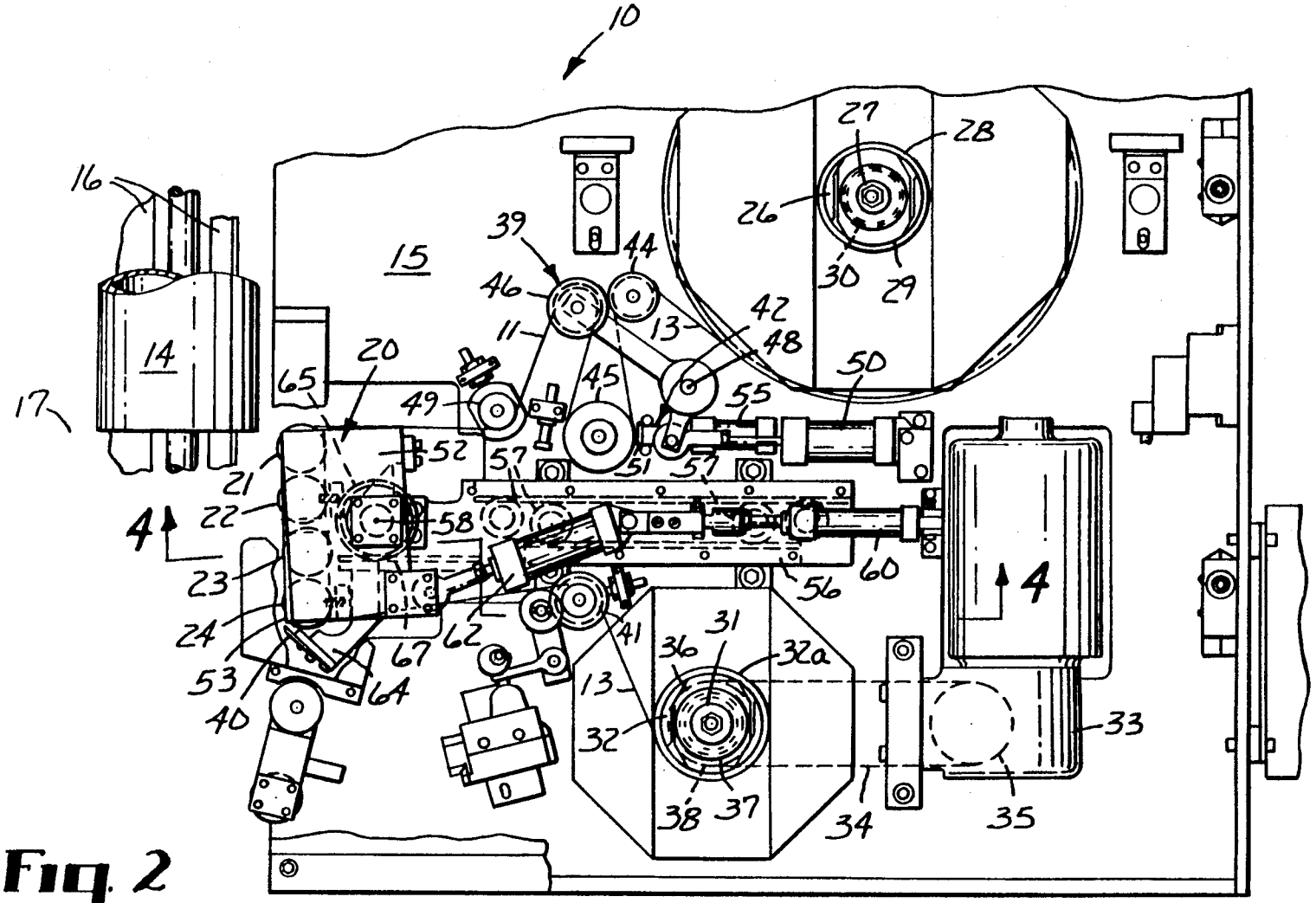
FIGS. 2 and 3 are top plan views of a device according to the present invention sequentially illustrating positions of portions of the device during application by the device of pressure sensitive adhesive along the length of an elongate member.
Figure 6:
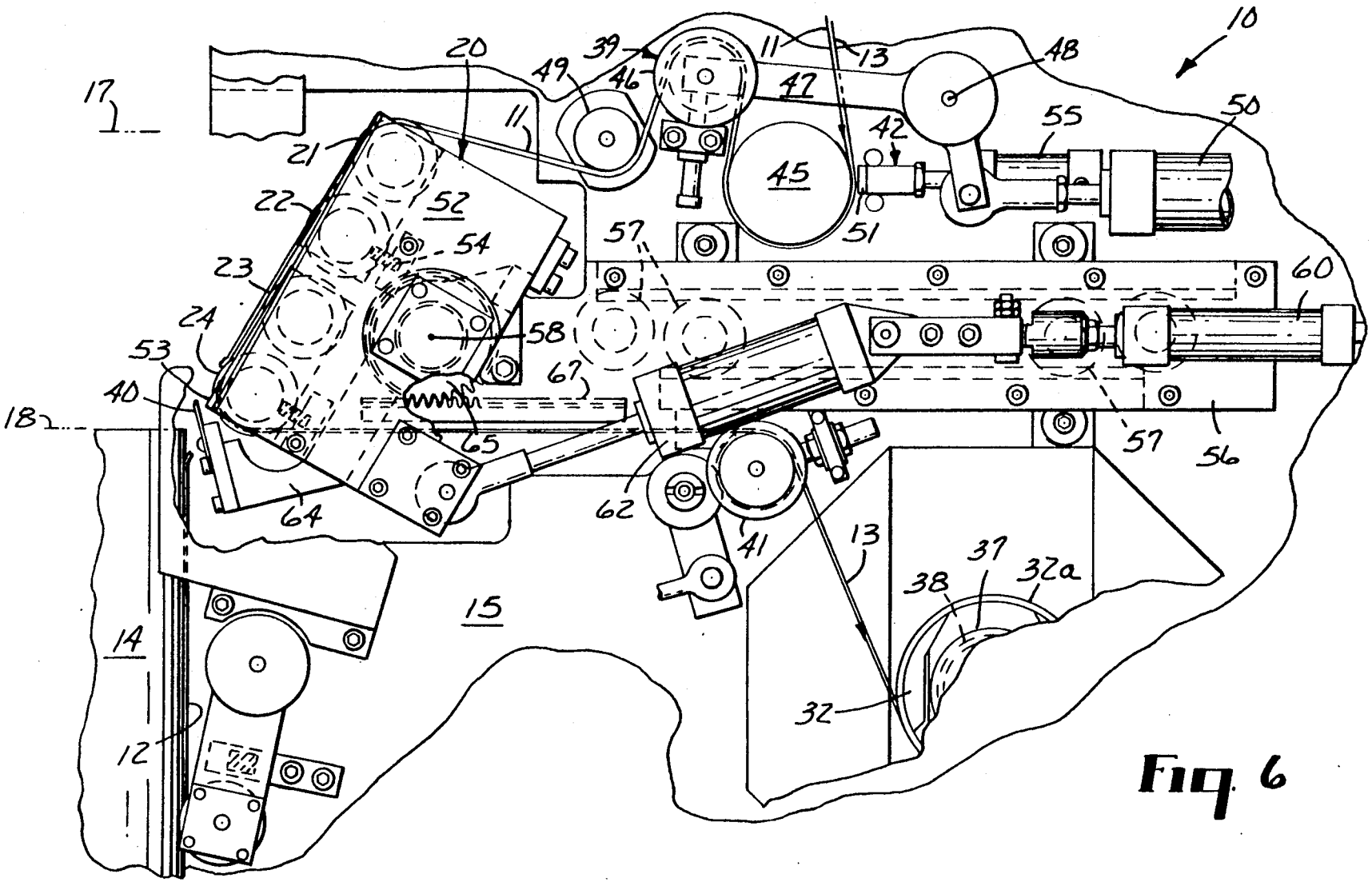

For an operation cycle of the device 10 the control means of the device 10 initially (FIG. 2) has positioned the movable guide roller 46 in its first position to define the long path portion length for the liner 13 supply path portion, has positioned the leading end of the length 11 of adhesive along the liner 13 adjacent the first pressure roller 21, has activated the brake means 42 and has activated the air cylinder 62 to rotate the head 20 to its first position. Upon movement of the elongate member 14 along the elongate member path in the first direction to position the leading or first end of the elongate member 14 in the initial position 17 as is illustrated in FIG. 2, the control means senses that position of the elongate member 14 as by a switch (not shown) and deactivates the break means 42, and activates the air cylinder 60 to bias the slide 56 to its pressure position, thereby positioning the head 20 in the contact position illustrated in FIG. 3 so that only the first pressure roller 21 presses the liner 13 and thereby the length 11 of adhesive adjacent the end of the length 11 of adhesive against the side surface of the elongate member 14 adjacent its first end. Upon further movement of the elongate member 14 along the elongate member path in the first direction, also sensed as by a switch, the control means deactivates and vents the air cylinder 62 so that the head 20 will rotate about the axis 58 to its second position (FIG. 5) whereupon further movement of the elongate member 14 along the elongate member path and tension in the liner 13 caused by the pull of the gear motor 33 through the friction clutch 37 in the liner collecting means will cause the length 11 of adhesive 11 and the liner 13 to move with the elongate member 14 and the adhesive 11 will be firmly pressed into engagement along the length of the side surface of the elongate member 14 through the liner 13 by all of the pressure rollers 21, 22, 23, and 24 as a result of pressure applied by the air cylinder 60 as the elongate member 14 with the adhesive 11 adhered thereto moves past pressure rollers 21, 22, 23 and 24 on the head 20. During such movement of the elongate member 14 tension in the liner 13 caused by the tension applying guide roller 45 will move the movable guide roller 46 of the length changing means 39 from the long position to the short position illustrated in FIGS. 5 and 6. Upon still further movement of the elongate member 14 along the elongate member path in the first direction when the trailing or second end of the elongate member 14 passes the outlet position 18 along the elongate member path, also sensed as by a switch, the control means activates the air cylinder 62 to rotate the head 20 to its third position with only the last pressure roller 24 pressing the adhesive against the elongate member 14, and simultaneously activates the air cylinder 60 to move the slide 56 to its retracted position which through the rack 67 and gear 65 moves the blade 40 of the cutting means from the retracted position to the engaged position to sever adhesive 11 extending between the last pressure roller 24 and the elongate member 14. The control means then activates the cylinder 55 as is illustrated in FIG. 6 to move the brake means 42 to the engaged position with the end portion 51 against the tension applying guide roller 45 to stop movement of the liner and supply length 11 of adhesive along the path due to friction of the adhesive on the roller 45, and activates the air cylinder 50 to move the movable guide roller 46 and thereby the length changing means 39 from the short position to the long position to pull the liner 13 along the head 20 from the last pressure roller 24 toward the first pressure roller 21 to move the newly severed end of the adhesive 11 from adjacent the last pressure roller 24 to adjacent the first pressure roller 21, and returns to the initial conditions of the device 10 indicated above.

The present invention has now been described with reference to one embodiment thereof. It will be apparent to those skilled in the art that many changes can be made in the embodiment described or its operational cycle without departing from the scope of the present invention. Thus the scope of the present invention should not be limited to the structure and operational cycle described in this application, but only by structure and operational cycle described by the language of the claims and the equivalents of those structures and cycles.

We claim:

1. A device adapted to apply a length of adhesive from a supply length of the adhesive releasably adhered to a liner along the length of an elongate member having first and second ends, said device comprising:

a frame;

means for guiding lengthwise movement of the elongate member along a elongate member path relative to said frame in a first direction with the first end of the elongate member leading from an initial position with the first end of the elongate member adjacent an initial position on the frame to an outlet position with the second end of the elongate members adjacent an outlet position on the frame, which outlet position is spaced in said first direction from said inlet position;

a head;

a plurality of pressure rollers comprising first and last pressure rollers each mounted on said head for rotation about an axis, the axes of said pressure rollers being parallel and said pressure rollers having generally aligned side surfaces adapted to press said adhesive against the side surface of said elongate member;

articulating and biasing means mounting said head on said frame between said initial and outlet positions along said elongate member path for movement in a predetermined pattern with the side surfaces of said pressure rollers adjacent said elongate member path, said first pressure roller adjacent said inlet position, and said last pressure roller adjacent said outlet position, said articulating and biasing means being adapted for biasing said pressure rollers to predetermined positions in said predetermined pattern;

supply support means on the frame for supporting a supply length of the liner having the length of adhesive releasably adhered thereto;

liner collecting means on the frame for collecting the liner after application of the length of adhesive and for applying a predetermined tension along said liner to move said liner into said liner collecting means;

means defining a liner path for the liner sequentially including a supply path portion from said supply support means to the first pressure roller adapted to guide the liner with the length of adhesive releasably adhered thereto to the first pressure roller with the liner adjacent the side surface of the first pressure roller, the last pressure roller, and a liner take up portion from the last pressure roller to said liner collecting means, said means for defining said supply path portion including length changing means movable between a short position for defining a short supply path portion length and a long position for defining a long supply path portion length that is longer than said short supply path portion length by a dimension about equal to the distance between the axes of said first and last pressure rollers;

cutting means including a cutting blade movable between a retracted position spaced from said liner path and said elongate member path and an engaged position with said blade at an engaged position intersecting said elongate member path and closely spaced from said liner path and on the side of said last pressure roller opposite said first pressure roller;

brake means along said supply path portion between said length changing means and said supply support means adapted for movement between a release position affording movement of the liner having the length of adhesive releasably adhered thereto along the liner path, and an engaged position for stopping movement of the liner having the adhesive releasably adhered thereto along the liner path;

said articulating and biasing means affording movement of said head between (1) a contact position with only said first pressure roller positioned to bias the liner having the length of adhesive releasably adhered thereto into engagement with the elongate member adjacent said inlet position, and (2) a pressure position with both said first and last pressure rollers positioned to bias the liner having the length of adhesive releasably adhered thereto into engagement with the elongate member along said elongate member path; and said device further including control means, operated by movement of said elongate member along said elongate member path with the first end of the elongate member leading, with the length changing means initially in said long position to define said long path portion length, and with the leading end of the length of adhesive initially adjacent said first pressure roller, for operating said articulating and biasing means to position said head in said contact position to press said liner and thereby the adhesive adjacent the end of the adhesive against the side surface of the elongate member at a position adjacent the first end of the elongate member, and then position said head in said pressure position so that further movement of the elongate member along the elongate member path and tension in the liner caused by said liner collecting means will cause the adhesive and the liner to move with the elongate member and the adhesive to be firmly pressed into engagement along the length of the side surface of the elongate member through the liner as the elongate member with the adhesive adhered thereto moves past the pressure rollers on the head;

allowing tension in said liner during movement of said elongate member past the pressure rollers on the head to move said length changing means from said long position to said short position;

moving said brake means to said engaged position while sequentially moving said cutting means from said retracted position to said engaged position to sever adhesive extending between said last pressure roller and said elongate member as the second end of said elongate member moves past said last pressure roller; and moving said length changing means from said short position to said long position to pull the liner along said head from said last pressure roller toward said first pressure roller to move the newly severed end of the adhesive from adjacent the last pressure roller to adjacent the first pressure roller.

2. A device according to claim 1 including four generally aligned and equally spaced pressure rollers mounted on said head assembly including said first and last pressure rollers and second and third pressure rollers positioned between said first and last pressure rollers with said third pressure roller adjacent said last pressure roller, said head comprises a major support portion with said first and third pressure rollers being rotatably mounted on said major support portion, and said head comprises minor support portions with said second and last pressure rollers being rotatably mounted on said minor support portions, said minor support portions being mounted on said major support portions for movement between projecting positions with said second and last pressure rollers moved slightly out of alignment with said first and third pressure rollers on the side of said head adjacent said elongate member path, and an aligned position in alignment with said first and third pressure rollers, and biasing means between said major and minor support portions for biasing said second and last pressure rollers toward said projecting positions so that when said pressure rollers are biased into engagement with the side surface of said elongate member through said major support member, movement of said minor support members against the influence of said biasing means will afford full engagement of all of said pressure rollers with said side surface despite some irregularities along said side surface.

3. A device according to claim 1 wherein said pressure rollers have axially central portions with generally the same diametrical dimensions and increase in diameter in both directions from said central portions so that the peripheries of the pressure rollers generally conform to the side surface of a cylindrical elongate member.

4. A device according to claim 1 wherein said articulating and biasing means comprise a slide mounted on said frame for movement in a first direction oriented at about a right angle with respect to said elongate member path between a pressure position and a retracted position at which said slide is spaced further from said elongate member path than in said pressure position;

means mounting said head on said slide for pivotal movement around a pivot axis, said pivot axis being parallel to the axes of said pressure rollers, being located about equidistant to the axes of said first and last pressure rollers and being spaced from the sides of said pressure rollers opposite said elongate member path, said head being pivotable about said pivot axis between a first position with said first pressure roller closer to said elongate member path than said last pressure roller, and a second position at which a line through the axes of said first and last pressure rollers is about parallel with said elongate member path;

slide actuating means connected between said frame and said slide for alternatively biasing said slide toward said pressure position or moving said slide to said retracted position; and head pivoting means connected between said head and said slide for pivoting said head between said first and second positions;

activation of said slide actuating means to bias said slide toward said pressure position and activation of said head pivoting means to pivot said head to said first position causing movement of said head to said contact position with only said first pressure roller positioned to bias the liner having the length of adhesive releasably adhered thereto into engagement with the elongate member adjacent said inlet position, and activation of said slide actuating means to bias said slide toward said pressure position and operation of said head pivoting means to afford pivoting of said head to said second position causing movement of said head to said pressure position with both said first and last pressure rollers positioned to bias the liner having the length of adhesive releasably adhered thereto into engagement with the elongate member along said elongate member path.

5. A device according to claim 4 wherein said head is pivotable about said pivot axis to a third position in addition to said first and second positions, at which third position said last pressure roller is closer to said elongate member path than said first pressure roller, and activation of said slide actuating means to move said slide to said retracted position and activation of said head pivoting means to pivot said head to said third position positions only said last pressure roller to bias the liner having the length of adhesive releasably adhered thereto into engagement with the elongate member along the elongate member path adjacent said outlet position and spaces the first pressure roller from the elongate member path; said cutting means includes a blade support member supporting said cutting blade and mounted on said slide for pivotal movement about said pivot axis for said head to afford movement of said cutting blade between said retracted and engaged positions, a gear fixed to said blade support member co axially with said pivot axis for said head, and a rack in engagement with said gear and fixed to said frame at a right angle to said elongate member path on the side of said gear adjacent said last pressure roller so that movement of said slide to said retracted position will cause movement of said blade to said engaged position with said blade intersecting said elongate member path and closely spaced from said liner path and on the side of said last pressure roller opposite said first pressure roller, and movement of said slide toward said pressure position will move said blade to said retracted position spaced from said liner path and said elongate member path.

6. A device according to claim 1 wherein said length changing means movable between a short position for defining a short supply path portion length and a long position for defining a long supply path portion length that is longer than said short supply path portion by a dimension about equal to the distance between the axes of said first and last pressure rollers comprises a pair of spaced fixed location liner guide rollers each being mounted on the frame for rotation about an axis fixed relative to the frame, a movable guide roller movable between a first position generally between the spaced fixed location liner guide rollers and a second position spaced at greater distance from said spaced fixed location liner guide rollers than when said movable guide roller is in said first position, and actuating means connected between said movable guide roller and said frame for moving said movable guide roller between said first and second positions, said liner extending around the side of said spaced fixed location liner guide rollers opposite said movable guide roller with a portion of the liner between said spaced fixed location liner guide rollers extending around the side of said movable guide roller opposite said spaced fixed location liner guide rollers.

* * * * *